US005711059A

United States Patent [19]

Schaefer

[11] Patent Number: 5,711,059

[45] Date of Patent: Jan. 27, 1998

[54] INTERNAL HIGH-PRESSURE FORMING PROCESS AND APPARATUS

[75] Inventor: August Wilhelm Schaefer, Drolshagen, Germany

[73] Assignee: Wilhelm Schaefer Maschinenbau GmbH & Company, Wilnsdorf, Germany

[21] Appl. No.: 436,944

[22] Filed: May 8, 1995

[30] Foreign Application Priority Data

May 9, 1994 [DE] Germany ..... 44 16 147.6

[51] Int. Cl.[6] ..... B23P 17/00; B21P 28/18; B23K 31/02

[52] U.S. Cl. ..... 29/423; 72/61; 228/157

[58] Field of Search ..... 29/421.1, 423; 228/157, 135, 125; 72/60, 61

[56] References Cited

U.S. PATENT DOCUMENTS

| | | | |
|---|---|---|---|
| 3,172,194 | 3/1965 | Pauls | 72/367 |
| 3,768,288 | 10/1973 | Jury | 72/61 |
| 5,016,805 | 5/1991 | Cadwell | 228/118 |
| 5,070,717 | 12/1991 | Boyd et al. | 29/421.1 |
| 5,083,371 | 1/1992 | Leibfried et al. | 228/157 |
| 5,115,963 | 5/1992 | Yasui | 228/157 |
| 5,228,615 | 7/1993 | Iijima et al. | 228/118 |
| 5,240,376 | 8/1993 | Velicki | 416/229 A |
| 5,253,419 | 10/1993 | Collot et al. | 29/889 |
| 5,349,839 | 9/1994 | Weykamp et al. | 72/61 |
| 5,404,630 | 4/1995 | Wu | 29/423 |
| 5,481,892 | 1/1996 | Roper et al. | 29/421.1 |

FOREIGN PATENT DOCUMENTS

| | | | |
|---|---|---|---|
| 0468221 | 1/1992 | European Pat. Off. . | |
| 4232161 | 3/1994 | Germany . | |
| 6226339 | 8/1994 | Japan | 72/61 |
| 2244222 | 11/1991 | United Kingdom . | |
| 2275436 | 8/1994 | United Kingdom . | |

OTHER PUBLICATIONS

Metal Industry, Feb. 22, 1946, pp. 144–147.

"Blech", Nov. 1957, p. 160.

*Primary Examiner*—David P. Bryant

*Assistant Examiner*—Tisa Stewart

*Attorney, Agent, or Firm*—Leydig, Voit & Mayer, Ltd.

[57] ABSTRACT

To produce an elongate hollow metal body with a cross-sectional contour varying in the longitudinal direction by the internal high-pressure forming process in an internal high-pressure forming press, a sheet-metal blank composed of two blank parts of identical area is first produced, each part having, apart from additional joining-area parts provided in the region of the longitudinal edges, in the longitudinal direction at least the length of the longitudinal hollow body and in the transverse direction at most half the length of the respective cross-sectional contour. Subsequently, the two blank parts are laid one on top of the other and are joined together, in particular welded, in the region of the joining-area parts. Thereafter, the sheet-metal blank is expanded by introducing a pressure medium between the two blank parts held within a tool consisting of two dies. The tool is so shaped that, when it is closed onto the blank, it produces a curved shape in the blank, with the result that the hollow body produced by expansion is curved and can have a cross-sectional contour which varies along its length.

17 Claims, 5 Drawing Sheets

INTERNAL HIGH-PRESSURE FORMING PROCESS AND APPARATUS

BACKGROUND OF THE INVENTION

The invention relates to an internal high-pressure forming process to produce a metallic elongate hollow body and to an internal high-pressure forming press suitable therefor, with a pressure medium-supplying tool.

An internal high-pressure forming process for producing elongate hollow bodies became known through the journal "Metal Industry", 22 Feb. 1946, pages 144 to 147. There, first of all a sheet-metal blank composed of two blank parts of identical area is produced, each having—apart from additional joining-area parts provided in the region of the longitudinal edges—in the longitudinal direction at least the length of the hollow body and in the transverse direction at most half the length of the respective cross-sectional contour. The two blank parts are laid one on top of the other between heated dies and are joined together in the region of the joining-area parts, and thereafter the sheet-metal blank is expanded or inflated in an internal high-pressure forming press by introducing a pressure medium between the two blank parts. Cooling elements produced in this way possess parallel cooling channels, a curvature of the cooling channels being achieved by appropriate guidance of the joining-area parts. The cooling channels have, in principle, a constant cross-section.

From the German journal "Blech", 1957, page 160, it is known to superpose aluminium sheets in sandwich fashion and to weld them into a unit by rolling. Prior to this, graphite has been applied at desired locations between the aluminium sheets, so that the sheets are not welded at these locations during the rolling operation. By hydraulic opening or blowing out at the non-welded locations, a pipe or a coiled-pipe system can be obtained and this can be subsequently deformed, for example, into an evaporator compartment of a refrigerator. Here, too, cooling channels of constant cross-section are produced, and the joining-area regions are provided, in the case of both known processes, only because of the multiple juxtaposed arrangement of channels. There is no indication in these references that from the start a varying cross-sectional geometry can be used and the joining-area regions are connected with the varying cross-sectional geometry.

The object of the invention is to produce elongate hollow bodies with varying cross-sectional changes, which cannot be obtained by use of the known internal high-pressure forming process on pipe sections of constant cross-section.

SUMMARY OF THE INVENTION

This object is achieved in that the invention teaches the use of the known internal high-pressure forming process, mentioned hereinabove, for the purpose of the production of a curved metallic elongate hollow body with a cross-sectional contour varying in the longitudinal direction, the sheet-metal blank being curved in the course of the closure of the internal high-pressure forming press in the plane perpendicular to the sheet-metal blank.

In this regard, the invention starts out from the realisation that in the course of the measures mentioned varying cross-sectional changes of the elongate hollow body, which have hitherto not been achievable, are possible by the use of a double sheet-metal blank and curvature, as well as subsequent expansion of the sheet-metal blank according to the internal high-pressure forming process. The sheet-metal blank constitutes a starting material which, as it were, contains the end product, developed into a plane, in two equal-size parts and additionally has the joining-area parts for joining these two parts. Above all, the complexity of the end product to be produced is further increased here by the curving of the sheet-metal blank, in the course of the closure of the internal high-pressure forming press, in the plane perpendicular to the sheet-metal blank.

The corresponding work then no longer needs to be performed in the course of the expansion. In contrast to the known measures, the hollow body removed from the internal high-pressure forming press then, of course, still has the joining-area parts, which are joined together. This is advantageous in many cases, such as for example in the automotive industry, since these flange-like joining-area parts can be used for the connection of further sheet-metal parts.

Thus, in a preferred embodiment, the arrangement is such that the joining-area parts are formed continuously at at least one of the two longitudinal edges. Naturally, the continuous joining-area parts may be provided at both longitudinal edges. These continuous joining-area parts of the two blank parts are welded together regularly over their entire length for example by roll seam or laser welding.

Another possibility consists in forming the joining-area parts, at at least one of the two longitudinal edges, from joining lugs which are arranged with longitudinal spacing from one another. It is true that in this case the pressure medium will exhibit certain leakage losses between the joining lugs in the course of the expansion, but these can be readily compensated for by appropriate supplementary delivery of the pressure medium. In any case, the joining lugs can be cut off after the expansion of the sheet-metal blank, so that the possibility exists of still welding in sheet-metal parts between the mutually facing longitudinal edges, or else of obtaining two independent mirror-inverted components.

A further preferred embodiment, to which particular importance is attached in the context of the invention, consists in bringing certain regions of at least one of the two blank parts to different thickness by rolling before the uniting to form the sheet-metal blank. This opens up a further possibility for supplementary deliveries of material in the course of the expansion, which is not possible when the sheet-metal blank parts are of constant thickness. On the other hand, by this measure it is possible to realise increases in wall thickness which are desirable for the overall strength.

As regards apparatus, the invention provides an internal high-pressure forming press for the described process, with a pressure medium-supplying tool, which consists of a splitting chisel capable of being inserted between the two blank parts of the sheet-metal blank at one longitudinal end of the blank.

BRIEF DESCRIPTION OF THE DRAWINGS

The invention is described in greater detail hereinbelow with reference to drawings representing an exemplary embodiment, in which.

DESCRIPTION OF THE PREFERRED EMBODIMENTS

Figure 7:
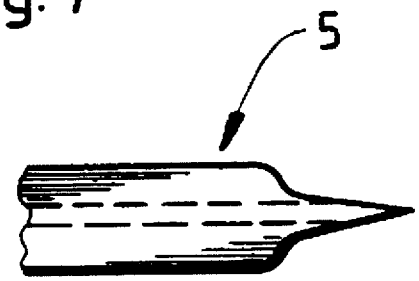
FIG. 7 shows a pressure medium-supplying tool.

To produce a curved metallic hollow elongate body with a cross-sectional contour varying along its length, (cf. FIGS. 3 to 5), the following procedure is employed, using the internal high-pressure forming process in an internal high-pressure forming press: first of all, a sheet-metal blank 1 composed of two blank parts 2, 3 of identical area is produced. Each part 2, 3 has, apart from additional continuous joining-area parts 4 provided in the region of the longitudinal edges, in the longitudinal direction a length at least equal to the length of the hollow body and in the transverse direction at most half the length of the respective cross-sectional contour. The two blank parts 2, 3 are laid one on top of the other and are welded together over their entire length in the region of the continuous joining-area parts 4 by roll seam or laser welding (cf. FIG. 1 ). Subsequently, the sheet-metal blank 1 is inserted into an internal high-pressure forming press and it is curved in the course of the closure of the press in the plane perpendicular to the sheet-metal blank 1 (cf. FIG. 2). Thereafter, the sheet-metal blank 1 is expanded by introducing a pressure medium between the two blank parts 2, 3, these latter being applied against the inner surface of the internal high-pressure forming die, which has the outer contour of the hollow body as its inner contour. The introduction of the pressure medium between the two blank parts 2, 3 is effected by a splitting chisel 5 (cf. FIG. 7) which is inserted between the two blank parts 2, 3 of the sheet-metal blank 1 at one longitudinal end of the sheet-metal blank 1.

Figure 8:
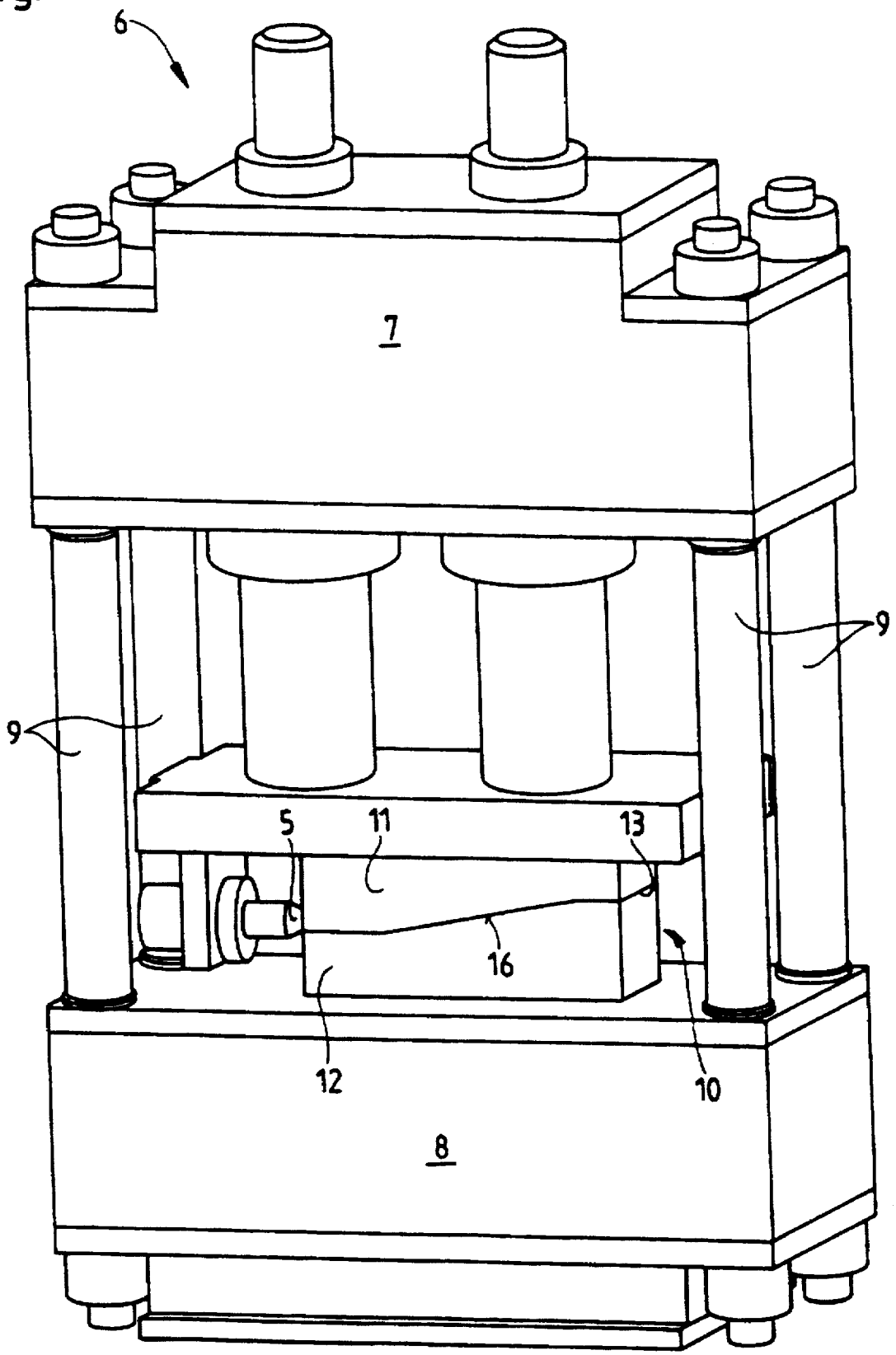
FIG. 8 is a perspective view of an internal high-pressure forming press suitable for use in accordance with the invention, and, FIG. 9 shows the press of FIG. 8 open, and a workpiece.
Figure 9:
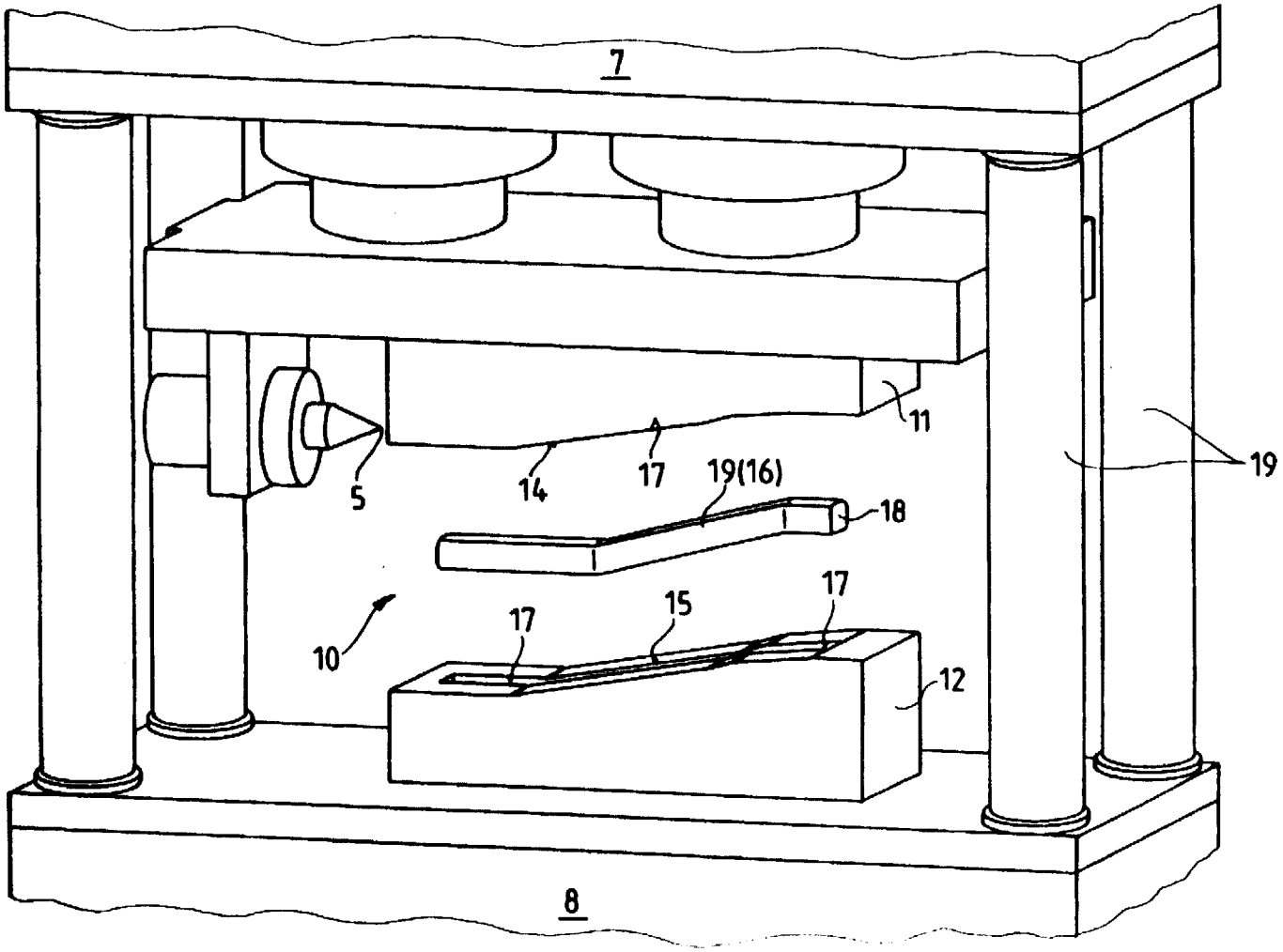

A suitable press 6 is shown in perspective in FIGS. 8 and 9. This has upper and lower crossheads or flames 7, 8, clamped together by four tie bars or columns 9. A two-part press tool 10 comprises a lower haft or die 12 which is stationary, mounted on the lower crosshead 8, and an upper half or die 11 mounted on a movable crosshead or platen 20 connected by fluid pressure rams or other pressure-exerting means 21 to the upper crosshead 7.

The upper and lower tool parts or dies 11, 12 have complementary contours or shapes, as can be seen from the parting surface 16 visible in FIG. 8.

The sheet metal workpiece components are prepared in a separate preliminary rolling step. The rolled sheet metal components are placed between the upper and lower dies which are then closed together. The shapes of the dies are such that on closure of the tool, the above-described curvature of the sheet metal blank is produced as an inherent consequence of the die contours. The contours of the dies define the form and degree of the curvature; it is not necessary to provide measuring equipment to control this.

Figure 1:
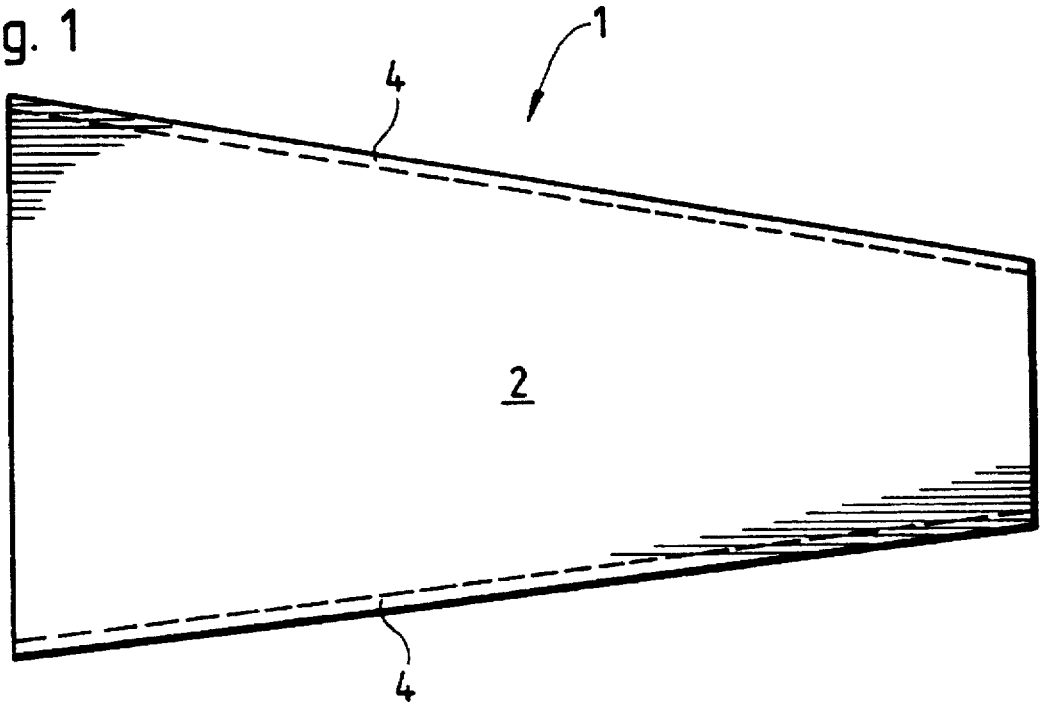
FIG. 1 shows a plan view of a sheet-metal blank.

With the blank held between the closed dies, pressure medium is admitted between the dies through the chisel 5 which, as shown in FIGS. 8 and 9, is mounted on the platen 20 and is inserted from the exterior of the tool 10 into the internal space within the tool and, therein, between the two components 2, 3 of the workpiece blank, which is for example as shown in FIG. 1. A suitable pressure medium source is connected to the chisel 5. The blank is thereby expanded, as described above.

As can be deduced from FIG. 9, the upper and lower dies 11, 12 are provided with mutually complementary internal contours or gravings 17 (not visible in the upper die). The die contours correspond to the desired external contour of the finished, shaped, hollow body 18. As a result of contours 14, 15 of the two dies, the finished body 18 has a curved or angled region 19 corresponding to the curvature 16 of the dies.

Figure 3:
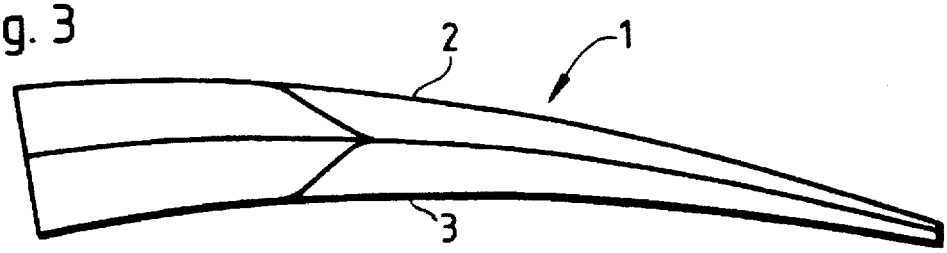
FIG. 3 shows the blank of FIG. 2 after the expansion.
Figure 4:
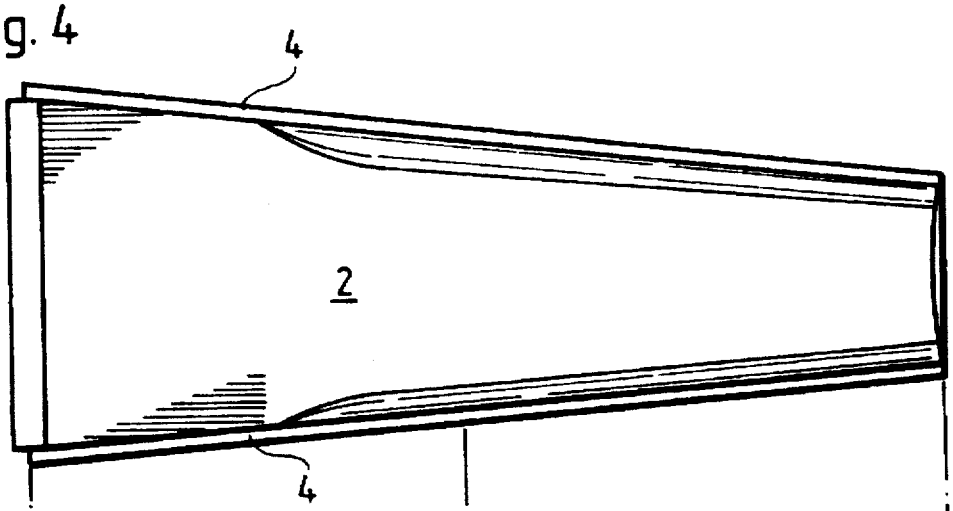
FIG. 4 shows a plan view of the expanded blank of FIG. 3.
Figure 5A:
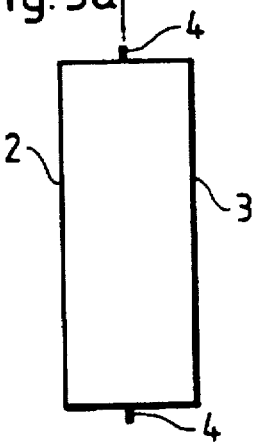
FIG. 5*a* to *c* shows cross-sections of the expanded blank of FIG. 4.
Figure 5B:
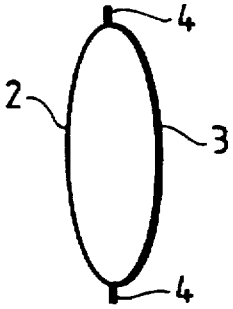
Figure 5C:
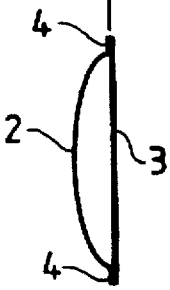

The cross-section of the tubular body 18 shown in FIG. 9 differs from that according to FIGS. 3 and 4; the expanded elongate hollow body of the latter has different cross sectional contours along its length as shown in FIGS. 5*a* to 5*c*.

The shape of the finished curved metal elongate body depends on the contours of the internal die recesses or grayings 17 provided in the dies, which contours can be selected freely to produce any desired final form of the workpiece.

Figure 6:
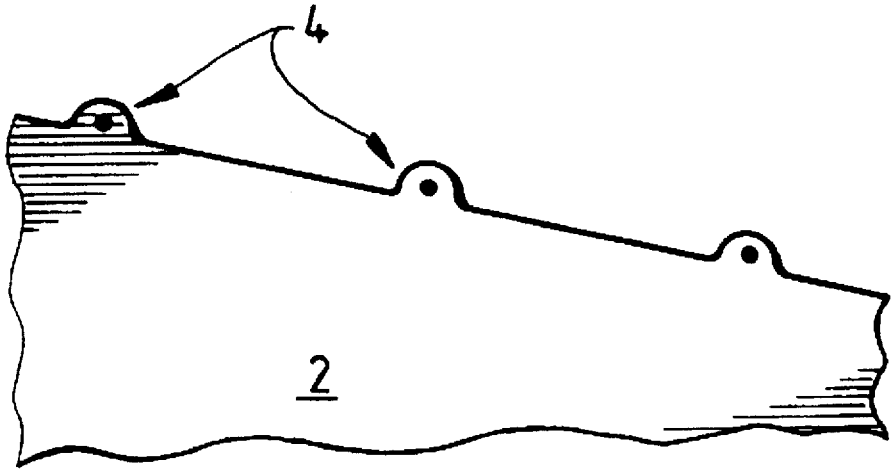
FIG. 6 shows a part of the blank of FIG. 1 in a modified embodiment.

FIG. 6 shows a modification: here, the joining-area parts 4 are formed as joining lugs which are arranged with longitudinal spacing from one another. These joining lugs 4 can be cut off after the expansion of the sheet-metal blank 1.

Figure 2:
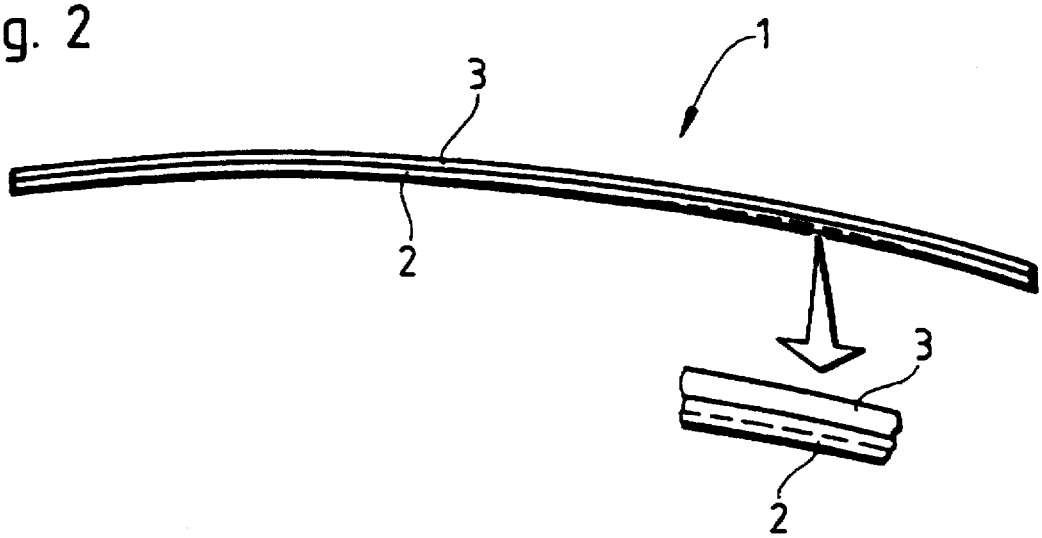
FIG. 2 shows a side view of the blank of FIG. 1 after putting into and closure of an internal high-pressure forming press.

In FIG. 2, a dashed line indicates the possibility of bringing certain regions of at least one of the two blank parts 2, 3 to different thickness by rolling before the uniting to form the sheet-metal blank 1, for example by adjustment of the rolling gap and/or pressure.

The process of the invention can be used to produce, for example, a forward frame for an automobile, the material and dimensions being determined by the desired properties for example stiffness, corrosion resistance etc. The pressures and temperatures used in the described production process are selected according to the shape, dimensions and material of the workpiece, suitable parameters being well known to those skilled in the art.

I claim:

1. A process for producing a hollow, elongated metal body comprising:

inserting a flat blank comprising two opposing pieces of sheet metal between first and second dies each having a cavity;

closing the dies to deform the blank into a nonplanar shape along an outer periphery of the blank surrounding the cavities while exposing an interior of the blank between the pieces of sheet metal to ambient pressure; then injecting a fluid under pressure into the blank between the pieces of sheet metal to expand the blank against the cavities and form a hollow body.

2. A process according to claim 1 wherein the blank has a varying width.

3. A process according to claim 1 wherein the blank is planar prior to being deformed into a nonplanar shape.

4. A process according to claim 1 including maintaining peripheral edges of the blank on opposite sides of the cavity aligned with each other.

5. A process according to claim 1 including joining the pieces of sheet metal to each other prior to inserting the blank between the dies.

6. A process according to claim 5 including rolling the pieces of sheet metal to join them together.

7. A process according to claim 5 including sealing each lengthwise side of the blank along its entire length prior to inserting the blank between the dies.

8. A process according to claim 7 including sealing the lengthwise sides by welding.

9. A process according to claim 5 including intermittently sealing each lengthwise side of the blank prior to inserting the blank between the dies.

10. A process according to claim 9 including sealing the sides by securing lugs on the pieces of sheet metal to each other.

11. A process according to claim 10 including cutting off the lugs after expanding the blank.

12. A process according to claim 10 including grasping the lugs between opposing surfaces of the dies surrounding the cavities.

13. A process according to claim 1 wherein one of the pieces of sheet metal has a varying thickness over its length.

14. A process according to claim 11 wherein injecting the fluid comprises forcing the pieces of sheet metal apart with a chisel and introducing the fluid through the chisel.

15. A process according to claim 1 including expanding the blank until the hollow body has a periphery at any transverse cross section at least twice a width of the blank at that cross section.

16. A press for forming an elongated hollow metal body from a sheet metal blank formed from two pieces of sheet metal comprising:

a first die having a first cavity and a first surface adjoining and surrounding the first cavity, the first cavity being recessed with respect to the first surface over an entire area of the first cavity;

a second die having a second cavity and a second surface opposing the first surface and adjoining and surrounding the second cavity, the second cavity being recessed with respect to the second surface over an entire area of the second cavity, the first and second surfaces having nonplanar complementary shapes and being shaped to grasp a sheet metal blank therebetween with opposite peripheral edges of the blank aligned with each other;

a support member supporting the first and second dies for relative movement of the dies between an open and a closed state; and a source of fluid under pressure for inflating a blank held between the dies to fill the first and second cavity.

17. A press according to claim 16 including a splitting chisel adjoining the dies and connected to the source of fluid for forcing the pieces of sheet metal apart and inserting the fluid into the blank between the pieces of sheet metal.

* * * * *